US010036516B2

(12) United States Patent
Yu et al.

(10) Patent No.: US 10,036,516 B2
(45) Date of Patent: Jul. 31, 2018

(54) LED LAMP

(71) Applicant: SHENZHEN UNIVERSITY, Shenzhen, Guangdong (CN)

(72) Inventors: Jianhua Yu, Guangdong (CN); Riguang Chen, Guangdong (CN); Xie Feng, Guangdong (CN); Lei E, Guangdong (CN)

(73) Assignee: SHENZHEN UNIVERSITY, Shenzhen (CN)

( * ) Notice: Subject to any disclaimer, the term of this patent is extended or adjusted under 35 U.S.C. 154(b) by 378 days.

(21) Appl. No.: 15/014,043

(22) Filed: Feb. 3, 2016

(65) Prior Publication Data

US 2016/0153622 A1 Jun. 2, 2016

Related U.S. Application Data

(63) Continuation of application No. PCT/CN2014/083406, filed on Jul. 31, 2014.

(30) Foreign Application Priority Data

Aug. 26, 2013 (CN) ..... 2013 1 0377015

(51) Int. Cl.

| | |
|---|---|
| ***F21K 99/00*** | (2016.01) |
| ***H05B 33/08*** | (2006.01) |
| ***F21V 29/70*** | (2015.01) |
| *F21V 3/06* | (2018.01) |
| *F21V 29/00* | (2015.01) |
| *F21Y 115/10* | (2016.01) |
| *F21Y 113/13* | (2016.01) |

(52) U.S. Cl.

CPC ..... *F21K 9/50* (2013.01); *F21V 29/70* (2015.01); *H05B 33/0803* (2013.01); *H05B 33/0815* (2013.01); *H05B 33/0857* (2013.01); *F21V 3/0625* (2018.02); *F21V 29/004* (2013.01); *F21Y 2113/13* (2016.08); *F21Y 2115/10* (2016.08)

(58) Field of Classification Search

CPC ..... H05B 33/0803; F21Y 2113/13; F21Y 2115/10

See application file for complete search history.

(56) References Cited

U.S. PATENT DOCUMENTS

2011/0279015 A1* 11/2011 Negley ..... F21K 9/137 313/501
2012/0056216 A1* 3/2012 Mitsuishi ..... C09K 11/0883 257/89
2014/0246990 A1* 9/2014 Kim ..... H05B 33/0866 315/250

FOREIGN PATENT DOCUMENTS

CN 101808451 A 8/2010

* cited by examiner

*Primary Examiner* — Elmito Breval

(57) ABSTRACT

The present invention discloses an LED lamp, which includes an LED light source module including at least one group of LED light source components, and further includes three drive circuits and a control circuit. The LED light source components include a first, a second, and a third LED light source. The first light source includes a first blue LED chip, a green phosphor is coated on the first blue LED chip. The second light source includes a second blue LED chip, a yellow phosphor is coated on the second blue LED chip. The third light source includes a third red LED chip. The control circuit determines drive currents of various LED light sources and drives the LED light sources through the drive circuits.

7 Claims, 10 Drawing Sheets

LED LAMP

CROSS-REFERENCE TO RELATED APPLICATIONS

This present application is a Continuation Application of PCT application No. PCT/CN2014/083406 filed on Jul. 31, 2014, which claims the benefit of Chinese Patent Application No. 201310377015.5 filed on Aug. 26, 2013, the contents of which are hereby incorporated by reference.

FIELD

The present invention relates to a lamp, and more particularly to a light emitting diode (LED) lamp.

BACKGROUND

An existing LED lamp typically includes a heatsink, a reflector, a diffuser plate, and a substrate having LED chips disposed thereon. Light of different colors emitted by the LED chips is synthesized into white light. Currently, it has been one of the main technical hotspots in the field of LED lighting to realize a color temperature adjustable lamp with a high color rendering index, and a method of mixing light of LEDs of different color temperatures or wavelengths is usually employed. However, it is not easy to achieve a high color rendering index, especially a high special color rendering index R9, which is required in many applications (for example, commodity exhibition). Therefore, attempts have been made to utilize a combination of phosphors or LEDs of different wavelengths. For example, in a patent application entitled "Method for Obtaining Color Temperature Adjustable White Light with High Color Rendering Index by Using Combination of White, Red and Blue LEDs" and published on Aug. 18, 2010 with a publication number CN101808451A, a blue LED chip is used to excite mixed yellow and green phosphors to produce warm white light, and then, the warm white light is mixed with a red LED light source and a blue LED light source of another wavelength to produce color temperature adjustable white light with a high color rendering index.

The above solution has several deficiencies below. 1. The coated phosphor is a mixture of a yellow phosphor and a green phosphor, a mixing ratio is not easy to control, and chrominance parameters of the finally synthesized white light are affected by an undesirable mixing ratio. Moreover, green fluorescent light is partially absorbed by the yellow phosphor, so that the excitation efficiency is reduced, the difficulty of setting the mixing ratio is further increased, and the design cost of the lamp is high. 2. Although the mixed white light is adjustable within the range of 2700K-6500K, the special color rendering index R9 is greater than 90 only, and the chromaticity difference ΔC is less than or equal to 0.01, so that the performance parameters cannot satisfy applications with high requirements. Moreover, the special color rendering index R9 is greater than 90 only within the range of 2700K-5000K, and R9 greater than 90 cannot be achieved within the entire adjustable color temperature range. 3. The two set blue LED chips have unequal peak wavelengths, increasing material selection and manufacturing costs.

SUMMARY

The technical problem to be solved by the present invention is: in order to overcome the above deficiencies of the prior art, an LED lamp is provided, in which a color temperature is adjustable within the range of 2700K-6500K, a general color rendering index Ra is more than 90, a special color rendering index R9 is more than 95, a chromaticity difference ΔC is less than 0.0054, and meanwhile the design and manufacturing costs of the lamp are low.

The technical problem of the present invention is solved through the following technical solution.

An LED lamp includes a heatsink, a reflector, a diffuser plate, and a substrate having an LED light source module disposed thereon, in which the LED light source module includes at least one group of LED light source components, and the LED lamp further includes three drive circuits and a control circuit; the LED light source components include a first LED light source providing blue-green light, a second LED light source providing yellow light, and a third LED light source providing red light; the first light source includes a first blue LED chip having a peak wavelength of 445-455 nm, a green phosphor having a peak wavelength of 500-520 nm is coated on the first blue LED chip, and blue light accounts for a luminous power proportion of 0.43-0.57 in the provided blue-green light; the second light source includes a second blue LED chip having a peak wavelength of 445-455 nm, a yellow phosphor having a peak wavelength of 557-570 nm is coated on the second blue LED chip, and blue light accounts for a luminous power proportion of 0-0.08 in the provided yellow light; the third light source includes a third red LED chip having a peak wavelength of 624-630 nm; the control circuit stores a correspondence table of a luminous flux ratio of each light source and chrominance parameters of a mixed light source; at the luminous flux ratio of each light source, the chrominance parameters satisfy the following conditions: a color temperature is adjustable within a range of 2700K-6500K, and at each color temperature, a general color rendering index Ra of the light source is greater than or equal to 90, a special color rendering index R9 is greater than or equal to 95, and a chromaticity difference ΔC is less than 0.0054; the control circuit selects, according to a mixed color temperature required by a user, a corresponding luminous flux ratio of each light source, determines a drive current of each light source according to the luminous flux ratio of each light source, and separately outputs the calculated drive current to a corresponding drive circuit; and the three drive circuits output the received drive currents to corresponding LED light sources and drive the corresponding LED light sources to emit light.

Compared with the prior art, the present invention has the following beneficial effects.

In the LED lamp of the present invention, the LED light source components are a first blue LED chip, a second blue LED chip, and a third red LED chip that are specially disposed so as to produce mixed light of a specific spectral power distribution. Meanwhile, the control circuit pre-stores a correspondence table of a luminous flux ratio of each light source satisfying conditions and chrominance parameters, selects a luminous flux ratio of each light source according to a required color temperature, and accordingly determines a drive current, outputs the drive current to each light source and drive the light source to emit light, so that the required color temperature is obtained, and meanwhile, a general color rendering index Ra of the light source is greater than or equal to 90, a special color rendering index R9 is greater than or equal to 95, and a chromaticity difference ΔC is less than 0.0054. In the LED lamp of the present invention, on the premise that the color temperature is adjustable within the range of 2700K-6500K, the general color rendering index Ra is greater than or equal to 90, the special color rendering index R9 is greater than or equal to 95, and the chromaticity difference ΔC is less than 0.0054, so that the chrominance parameters are desirable and can satisfy applications with high requirements. Meanwhile, the problem of a mixing ratio of different types of phosphors is not involved in the LED light source components, and the two blue LED chips have the same peak wavelength, so that both the design cost and the manufacturing cost of the lamp are low.

DESCRIPTION OF THE EMBODIMENTS

The present invention is described in further detail below through specific embodiments with reference to accompanying drawings.

First Specific Embodiment

The present invention uses a combination of a single type of blue LED having a peak wavelength of 445-455 nm, which is used to separately excite a green phosphor (having a peak wavelength of 500-520 nm) and a yellow phosphor (having a peak wavelength of 557-570 nm) to produce blue-green light and yellow light, and a red LED having a peak wavelength of 624-630 nm to achieve LED white light in which a color temperature is adjustable within the range of 2700K-6500K, a general color rendering index Ra is greater than or equal to 90, a special color rendering index R9 is greater than or equal to 95, and a chromaticity difference ΔC is less than 0.0054.

Figure 1:
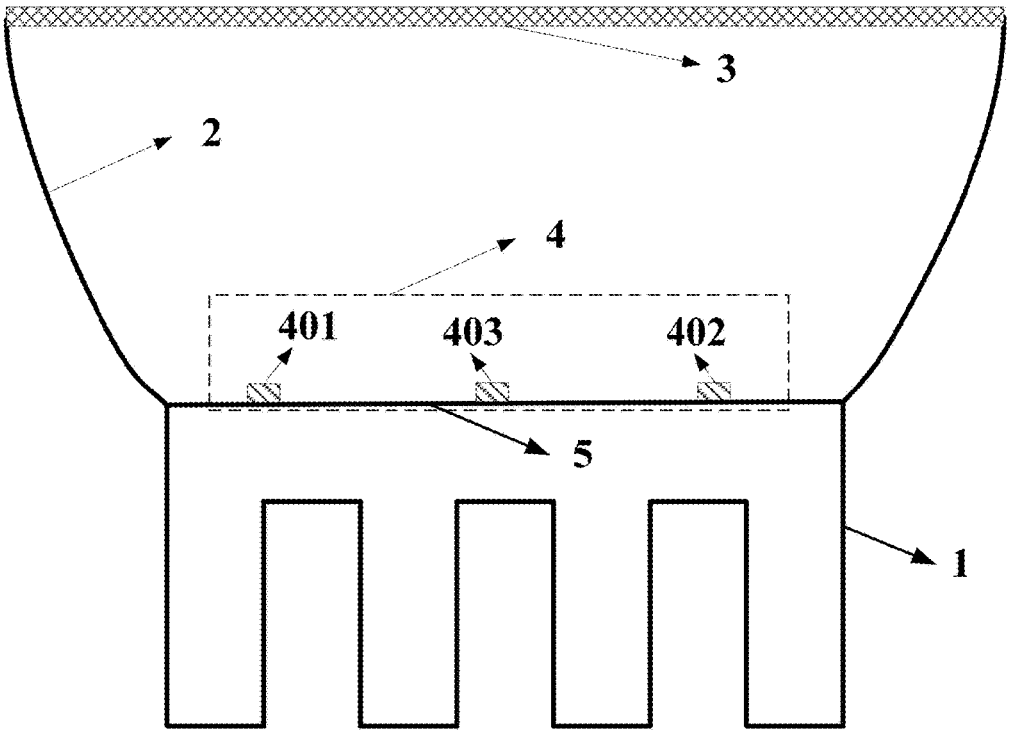
FIG. 1 is a schematic structural view of an LED lamp according to a first specific embodiment of the present invention.
Figure 2:
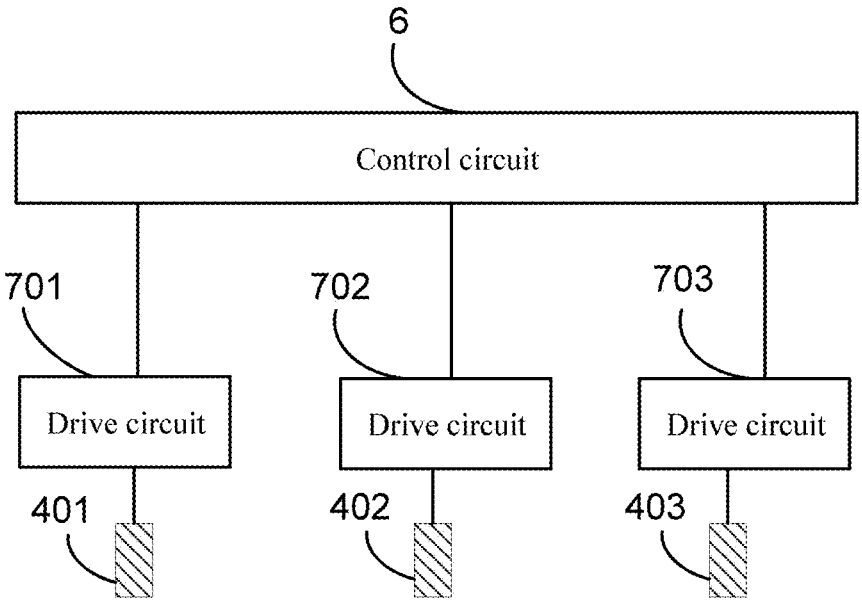
FIG. 2 is a schematic circuit diagram of the LED lamp according to the first specific embodiment of the present invention.

FIGS. 1 and 2 are respectively a schematic structural view and a schematic circuit diagram of an LED lamp according to this specific embodiment. The LED lamp includes a heatsink 1, a reflector 2, a diffuser plate 3, and a substrate 5 having an LED light source module 4 disposed thereon. The LED light source module 4 includes at least one group of LED light source components (one group is shown in FIG. 1). The LED lamp further includes three drive circuits 701, 702, 703 and a control circuit 6.

The LED light source components include a first LED light source 401 providing blue-green light, a second LED light source 402 providing yellow light, and a third LED light source 403 providing red light.

The first light source 401 includes a first blue LED chip having a peak wavelength of 445-455 nm, and a green phosphor having a peak wavelength of 500-520 nm is coated on the first blue LED chip, so that the first blue LED chip excites the green phosphor to produce blue-green light. By adjusting the adhesive powder proportion and coating amount of the green phosphor, blue light accounts for a luminous power proportion of 0.43-0.57 in the produced blue-green light (in the blue-green light, luminous power proportions of the blue light and green light add up to 1, that is, the green light also accounts for a luminous power proportion of 0.43-0.57). In this specific embodiment, a blue LED chip having a peak wavelength of 446 nm is used to excite a 507 nm green phosphor, and blue light accounts for a luminous power proportion of 0.44 in the blue-green light.

The second light source 402 includes a second blue LED chip having a peak wavelength of 445-455 nm, a yellow phosphor having a peak wavelength of 557-570 nm is coated on the second blue LED chip, so that the second blue LED chip excites the green phosphor to produce yellow light. By adjusting the adhesive powder proportion and coating amount of the yellow phosphor, blue light (transmitted through the blue LED chip) accounts for a luminous power proportion of 0-0.08 in the produced yellow light (that is, the yellow light accounts for a luminous power proportion of 0.92-1). In this specific embodiment, a blue LED chip having a peak wavelength of 446 nm is used to excite a 558 nm yellow phosphor, and blue light accounts for a luminous power proportion of 0.07 in yellow light.

The third light source includes a third red LED chip having a peak wavelength of 624-630 nm and provides red light. In this specific embodiment, a red LED having a peak wavelength of 627 nm is used.

Figure 3:
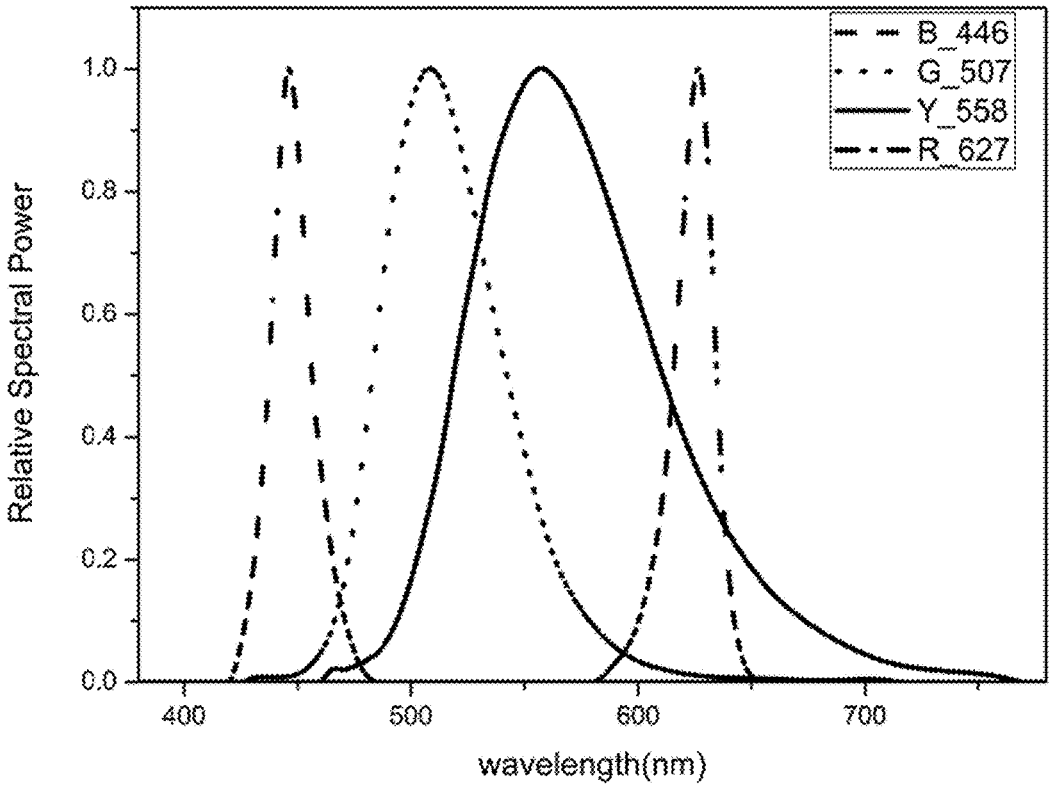
FIG. 3 is a diagram illustrating relative spectral power distributions of various chips and phosphors in a selected combination of the LED lamp according to the first specific embodiment of the present invention.
Figure 4:
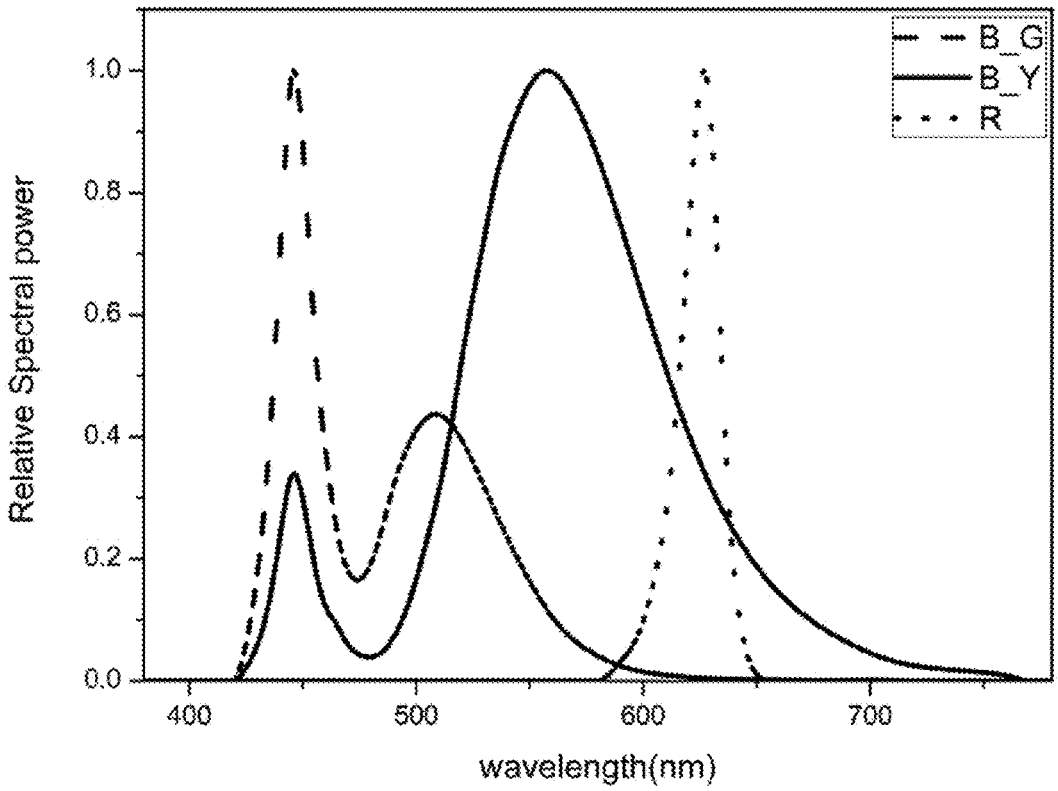
FIG. 4 is a diagram illustrating relative spectral power distributions of light of three colors in a combination and a group of blue light proportions of the LED lamp according to the first specific embodiment of the present invention.
Figure 5:
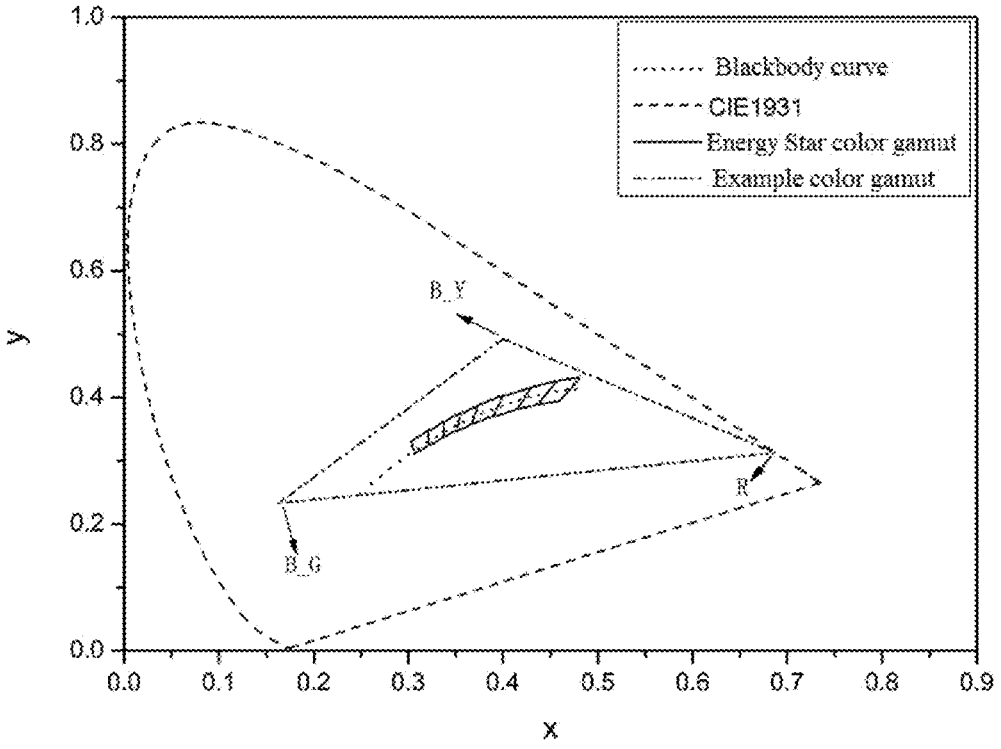
FIG. 5 is a schematic diagram illustrating color gamuts of light of three colors in a combination and a group of blue light proportions of the LED lamp according to the first specific embodiment of the present invention.

FIG. 3 is a diagram illustrating relative spectral power distributions of the 446 nm blue LED chip, the 627 nm red LED chip, the 507 nm green phosphor, and the 558 nm yellow phosphor that are selected in this specific embodiment. In FIG. 3, B represents the blue LED chip, G represents the green phosphor, Y represents the yellow phosphor, and R represents the red LED chip. In the above combination, the adhesive powder proportions and coating amounts of the phosphors are adjusted, so that blue light accounts for a luminous power proportion of 0.44 and a luminous power proportion of 0.07 in blue-green light and yellow light respectively, so as to produce relative spectral power distributions of the blue-green light, yellow light, and red light as shown in FIG. 4. In FIG. 4, B_G represents the blue-green light, B_Y represents the yellow light, and R represents the red light. In the above combination and proportions, color coordinates of the produced blue-green light, yellow light, and red light are (0.1631, 0.2332), (0.3999, 0.4924), and (0.6868,0.3130) respectively, and a schematic diagram illustrating color gamuts thereof is shown in FIG. 5. As can be known from FIG. 5, a triangular range formed by the color coordinates of the light of the three colors covers an Energy Star color gamut, which indicates that light obtained by mixing the three types of light at the color coordinates can achieve a color temperature adjustable within the range of 2700K-6500K.

It should be noted that when a combination of other values within the ranges is selected, peaks of the waveforms in FIG. 4 will be shifted. When the luminous power proportions of the blue light in the blue-green light and the yellow light are set to other values within the ranges, relative power values at corresponding wavelengths will be changed, and the compression and expansion status of the waveforms will be different. However, regardless of the waveform peak shifts or the waveform compression and expansion changes, generally, in the combination of the blue LED chip of 445-455 nm, the red LED chip of 624-630 nm, the green phosphor of 500-520 nm, and the yellow phosphor of 557-570 nm, when the blue light accounts for a luminous power proportion of 0.43-0.57 and a luminous power proportion of 0-0.08 in the blue-green light and the yellow light, a relative spectral power distribution diagram of mixed light is similar to FIG. 4, and a triangle formed by color coordinates of the obtained light of three colors also can cover the Energy Star color gamut, and light obtained by mixing the three types of light also can achieve a color temperature adjustable within the range of 2700K-6500K.

During operation of circuit components in the LED lamp, the control circuit 6 stores a correspondence table of a luminous flux ratio of each light source and chrominance parameters of a mixed light source; at the luminous flux ratio of each light source, the chrominance parameters satisfy the following conditions: a color temperature is adjustable within the range of 2700K-6500K, and at each color temperature, a general color rendering index Ra of the light source is greater than or equal to 90, a special color rendering index R9 is greater than or equal to 95, and a chromaticity difference ΔC is less than 0.0054; the control circuit selects, according to a mixed color temperature required by a user, a corresponding luminous flux ratio of each light source, determines a drive current of each light source according to the luminous flux ratio of each light source, and outputs the calculated drive currents to corresponding drive circuits 701, 702, and 703 respectively.

The three drive circuits 701, 702, and 703 output the received drive currents to corresponding LED light sources 401, 402, and 403 and drive the corresponding LED light sources to emit light. The three drive circuits 701, 702, and 703 drive the three LED light sources by means of pulse width modulation (PWM). The PWM mode is used to adjust and control the pulse width of an input current of each LED light source so that the LED light source always operates at a full-amplitude current and zero, thereby reducing the color spectrum offset. PWM signals may be generated by using a single-chip microcomputer with a 16-bit timer, and divided into 65536 gray levels. In this way, the control precision can be improved and the light can be changed gently.

The control circuit 6 adjusts the drive currents through the drive circuits, so as to control the luminous flux output of each light source, so that the LED lamp outputs mixed white light obtained after mixing at corresponding luminous flux ratios, so that mixed white light at a desired color temperature is output, and at the color temperature, a general color rendering index Ra is more than 90 and a special color rendering index R9 is more than 95.

How to obtain the correspondence table of luminous flux ratios and chrominance parameters of the mixed light source is described in detail below.

First, chrominance parameters such as a color temperature, a color rendering index, and a chromaticity difference of a light source are determined by a relative spectral power distribution of light obtained after mixing three colors. The relative spectral power distribution S(λ) of the mixed light is calculated as shown in equation (1):

$$S(\lambda)=K_1*S_{B_G}(\lambda)+K_2*S_{B_Y}(\lambda)+K_3*S_R(\lambda) \quad (1)$$

where $S_{B_G}(\lambda)$, $S_{B_Y}(\lambda)$, and $S_R(\lambda)$ are respectively relative spectral power distributions of blue-green light, yellow light, and red light participating in light mixing, and $K_1$, $K_2$, and $K_3$ are luminous power ratios corresponding to the blue-green, yellow, and red LEDs participating in light mixing. Therefore, relative spectral power distributions of LEDs participating in light mixing and luminous power ratios among them must be known in order to determine a color temperature and a color rendering index of mixed light. As described earlier, when the peak wavelengths of the used LED chips and phosphors and the amounts of the phosphors are determined, the power distribution of the mixed light is determined (as shown in FIG. 4). Therefore, a different S(λ) is obtained by setting a different luminous power ratio combination, and the S(λ) eventually influences values of the chrominance parameters (equations for calculating chrominance parameters such as a color temperature, a general color rendering index Ra, a special color rendering index R9, a chromaticity difference, and an efficacy of radiation according to S(λ) are known). To sum up, the mixed light source has different color temperatures, color rendering indexes, and chromaticity differences with different luminous power ratio combinations.

Figure 6:
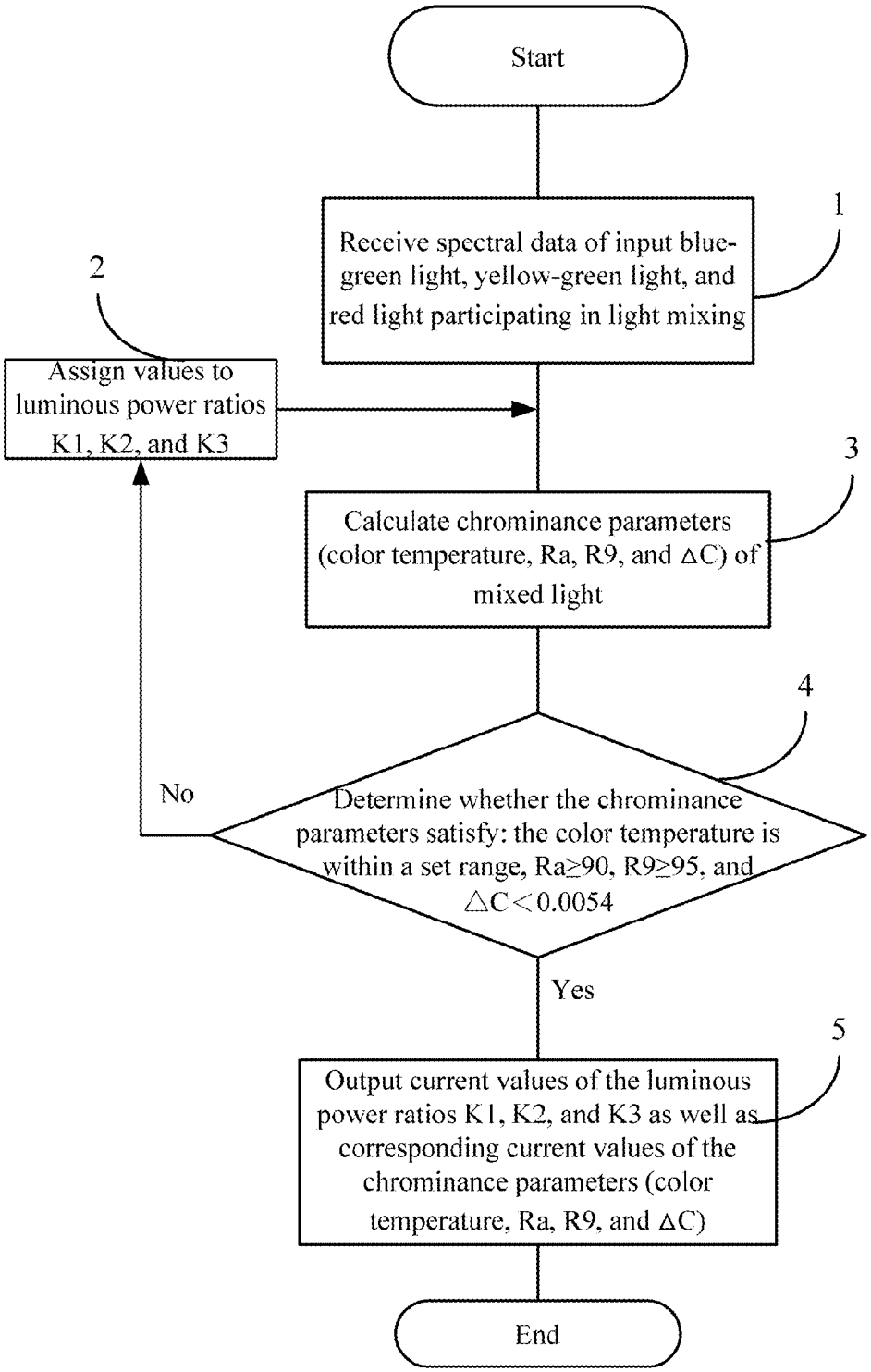
FIG. 6 is a flowchart of a method for calculating luminous flux ratios satisfying conditions in the first specific embodiment of the present invention.

FIG. 6 is a flowchart of a method for calculating luminous flux ratios satisfying conditions. As shown in FIG. 6, the method includes the following steps. 1) Receive relative spectral power distribution data of blue-green light, yellow light, and red light. 2) Assign values to a luminous power ratio K1 of the blue-green light, a luminous power ratio K2 of the yellow light, and a luminous power ratio K3 of the red light. 3) Calculate chrominance parameters of mixed light. Specifically, a relative spectral power distribution of mixed light is calculated according to the above equation (1), and then, chrominance parameters of the mixed light source are calculated according to the relative spectral power distribution of the mixed light, in which these chrominance parameters include a color temperature, a general color rendering index Ra, a special color rendering index R9, a chromaticity difference, and an efficacy of radiation. A calculation equation for calculating the chrominance parameters according to the relative spectral power distribution S(λ) of the mixed light is already known and will not be described in detail herein. 4) Determine whether the chrominance parameters satisfy the following conditions: the color temperature of the mixed light is within a set range (that is, the color temperature may fluctuate within a certain range of a set value; for example, if the set value of the color temperature is 2700K, color temperatures within the range of 2695K-2705K all can be regarded as a color temperature of 2700K), the general color rendering index Ra is greater than or equal to 90, the special color rendering index R9 is greater than or equal to 95, and the chromaticity difference ΔC is less than 0.0054, and if yes, enter step 5), i.e., output current values of the luminous power ratio K1 of the blue-green light, the luminous power ratio K2 of the yellow light, and the luminous power ratio K3 of the red light as well as corresponding current values of the chrominance parameters; if not, return to step 2), i.e., perform value assignment and calculation again until the luminous power ratio K1 of the blue-green light, the luminous power ratio K2 of the yellow light, and the luminous power ratio K3 of the red light satisfying conditions are obtained.

After the luminous power ratios K1, K2, and K3 satisfying conditions are obtained, because of the correspondence between luminous power ratios and luminous flux ratios, luminous flux ratios can be calculated according to the luminous power ratios. The calculation equations are:

$$\eta_n = \frac{K_n * LER_n}{\sum_{n=1}^{3} K_n * LER_n} \quad (2)$$

$$n = (1, 2, 3)$$

$$LER = \frac{a_m \int_\lambda S(\lambda) * V(\lambda) d\lambda}{\int_\lambda S(\lambda) d\lambda} \quad (3)$$

In the equations, $\eta_n$, $K_n$, and $LER_n$ respectively correspond to a luminous flux ratio, a luminous power ratio, and an efficacy of radiation of each light source (corresponding to the blue-green light when n=1, corresponding to the yellow light when n=2, and corresponding to the red light when n=3), the value of $\alpha_m$is 6831 m/W, V(λ) is a luminosity function, and S(λ) is relative spectral power distribution data of the corresponding light source.

The correspondence between the luminous flux ratio of each light source and the color temperature, the general color rendering index Ra, the special color rendering index R9, and the chromaticity difference ΔC of the mixed light source can be obtained according to the above calculation method, and the color temperature is adjustable within the range of 2700K-6500K, and at each color temperature, the general color rendering index Ra of the mixed light source is greater than or equal to 90, the special color rendering index R9 is greater than or equal to 95, and the chromaticity difference ΔC is less than 0.0054.

Figure 7:
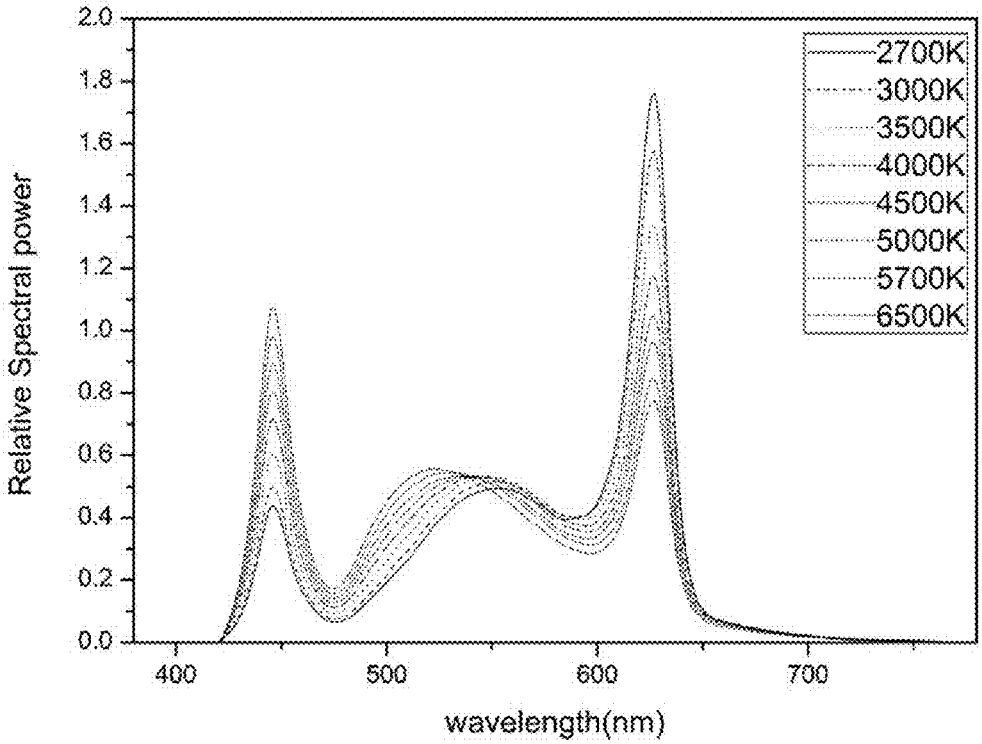
FIG. 7 illustrates a correspondence table of luminous flux ratios and chrominance parameters calculated in a combination and a group of blue light proportions of the LED lamp according to the first specific embodiment of the present invention.

Still using the situation in which the blue LED chip having a peak wavelength of 446 nm, the red LED chip having a peak wavelength of 627 nm, the green phosphor having a peak wavelength of 507 nm, and the yellow phosphor having a peak wavelength of 558 nm are combined, and blue light accounts for a luminous power proportion of 0.44 and a luminous power proportion of 0.07 in blue-green light and yellow light respectively as an example for description, the obtained correspondence table of the luminous flux ratio of the mixed white light and various chrominance parameters is shown in the following table, and the obtained relative spectral power distribution of the mixed white light is shown in FIG. 7.

| Color temperature (CCT) | General color rendering index Ra | Special color rendering index R9 | Chromaticity difference ΔC | Efficacy of radiation LER (lm/W) of mixed white light | Color coordinate x | Color coordinate y | Luminous flux ratio of each light source: Yellow light B_Y | Red light R | Blue-green light B_G |
|---|---|---|---|---|---|---|---|---|---|
| 2700 K | 90 | 95 | 0.0053 | 345 | 0.4505 | 0.3946 | 0.6576 | 0.2463 | 0.0961 |
| 3000 K | 91 | 95 | 0.0034 | 348 | 0.4321 | 0.3941 | 0.6714 | 0.2149 | 0.1137 |
| 3500 K | 91 | 96 | 0.0012 | 347 | 0.4042 | 0.3875 | 0.6695 | 0.1794 | 0.1511 |
| 4000 K | 91 | 97 | 0.0002 | 341 | 0.3805 | 0.3772 | 0.6486 | 0.1580 | 0.1934 |
| 4500 K | 91 | 98 | 0.0019 | 336 | 0.3614 | 0.3679 | 0.6269 | 0.1419 | 0.2312 |
| 5000 K | 91 | 97 | 0.0003 | 329 | 0.3454 | 0.3579 | 0.5975 | 0.1328 | 0.2697 |
| 5700 K | 91 | 97 | 0.0029 | 323 | 0.3277 | 0.3491 | 0.5740 | 0.1168 | 0.3092 |
| 6500 K | 91 | 97 | 0.0045 | 314 | 0.3117 | 0.3370 | 0.5316 | 0.1108 | 0.3576 |

As can be known from the above table, by controlling luminous flux ratios of three LEDs, namely, the blue-green, yellow, and red LEDs, mixed light with a corresponding color temperature at the ratios can be obtained, the color temperature is adjustable within the range of 2700K-6500K, and meanwhile, the general color rendering index Ra is more than 90, the special color rendering index R9 is more than 95 with a maximum of 98, the chromaticity difference ΔC is less than 0.0054, and the luminous efficacy of radiation (LER) is more than 314 lm/W with a maximum luminous efficacy of radiation (LER) of 348 lm/W.

As can be known from the relative spectral power distribution diagram of the mixed white light in FIG. 7, the LED lamp can achieve a color temperature continuously adjustable within the range of 2700K-6500K.

In the LED lamp according to this specific embodiment, three LED light sources are used, that is, a blue LED chip is used to excite a green phosphor to produce blue-green light, a blue LED chip is used to excite a yellow phosphor to produce yellow light, and a red LED chip is used to produce red light. Mixed light of a specific spectral power distribution is produced through a combination of peak wavelengths within certain ranges together with proportions of blue light in the blue-green light and the yellow light. During operation, a control circuit and drive circuits are used to adjust currents of different LED light sources, so as to adjust luminous flux outputs of different LED light sources and adjust luminous flux ratios among them, so that mixed white light at the corresponding color temperature at each luminous flux ratio is obtained, and the white light has desirable chrominance parameters, that is, the color temperature is adjustable while ensuring a high color rendering index and a desirable chromaticity difference and efficacy of radiation, thereby satisfying applications with high requirements. Meanwhile, the problem of a mixing ratio of the phosphors is not involved in the light source components of the LED lamp, and the two blue LED chips have the same peak wavelength, so that both the design cost and the manufacturing cost of the lamp are low. Second specific embodiment This specific embodiment is different from the first specific embodiment in that: based on the first specific embodiment, this specific embodiment further defines that multiple LED light sources are arranged in a circular array, and defines the setting of a radius r of the circle, preferable configuration of the reflector, the substrate, and the diffuser plate, and so on.

In the LED lamp according to this specific embodiment, the components, the connection between the components, and the operation process of the components are all the same as those in the first embodiment, and will not be repeated herein. Only the further defined contents are described in detail below.

In this specific embodiment, light spots of blue-green light, yellow light, and red light projected on a target diffuser panel are equal in size and uniform in illuminance by reasonably arranging the LED light source array; a frosted reflector is used to compress the light spots; a diffuser plate made from a PC or PMMA material or frosted glass is used to perform secondary light and color uniformization; and a substrate plated with a reflective film is used to collect rays reflected by the reflector and the diffuser plate to the bottom, thereby improving the light utilization rate of the system.

Figure 8:
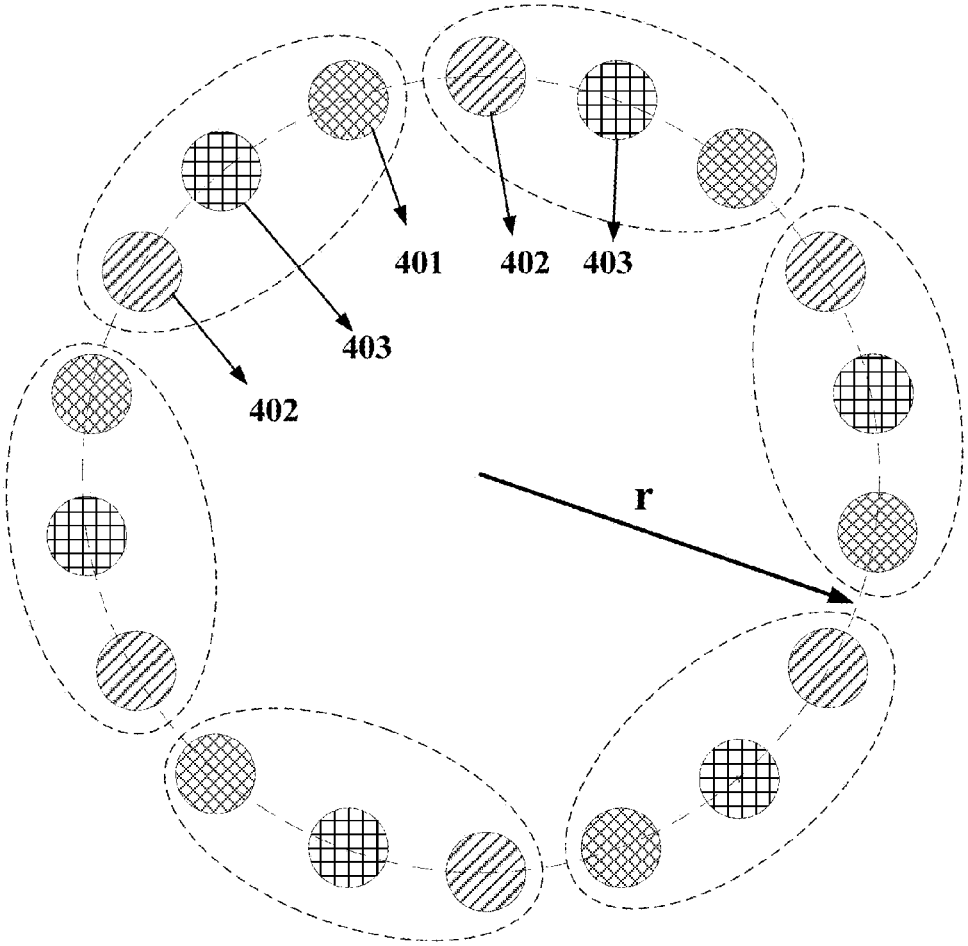
FIG. 8 is a schematic structural view illustrating arrangement of multiple LED light sources in an LED lamp according to a second specific embodiment of the present invention.

FIG. 8 is a schematic structural view illustrating arrangement of multiple LED light sources in the LED lamp according to this specific embodiment. As can be known from FIG. 8, the LED lamp includes 6 groups of LED light source components, each group of LED light source components includes 3 LED light sources, and a total of 18 LED light sources exist, the multiple LED light sources are arranged in a circular array, LED light sources providing light of different colors are disposed alternately, and all the LED light sources have the same light distribution curve. For example, a first LED light source 401 providing blue-green light has a second LED light source 402 and a third LED light source 403 adjacent thereto on both sides, a second LED light source 402 providing yellow light has a first LED light source 401 and a third LED light source 403 adjacent thereto on both sides, a third LED light source 403 providing red light has a first LED light source 401 and a second LED light source 402 adjacent thereto on both sides, and so on, so that LED light sources of different colors are disposed alternately.

All the LED light sources are arranged in a circular array, and the blue-green, yellow, and red LED light sources have the same light distribution curve and are all in the same circular array; then light spots of blue-green, yellow, and red LEDs projected on a target diffuser plate are equal in size and uniform in illuminance, so that white light synthesized on the surface of the diffuser plate also has a uniform color temperature distribution.

Figure 9A:
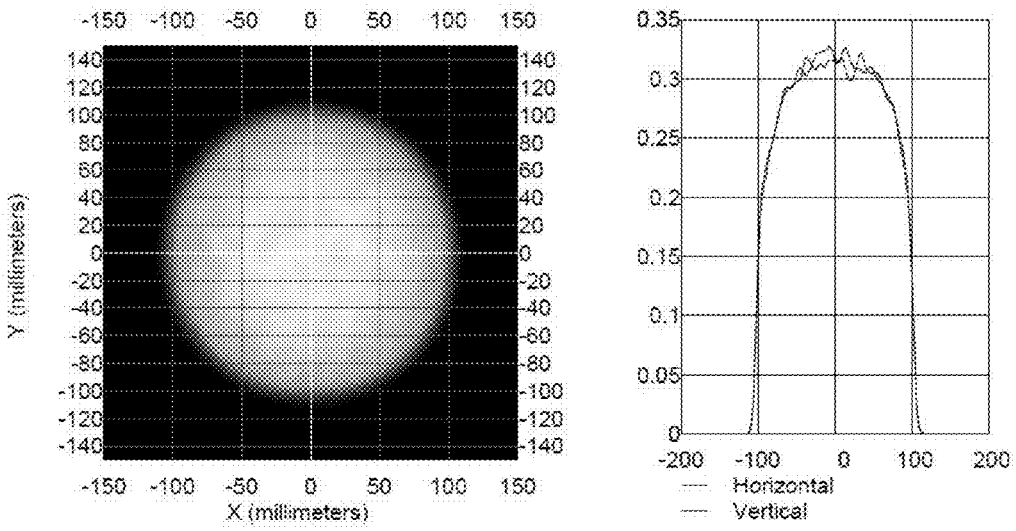
FIG. 9*a*, FIG. 9*b*, FIG. 9*c* are respectively a diagram illustrating light spots in an illuminance simulation design of an array of blue-green, yellow, and red LED light sources on the surface of a diffuser plate in the LED lamp according to the second specific embodiment of the present invention.
Figure 9B:
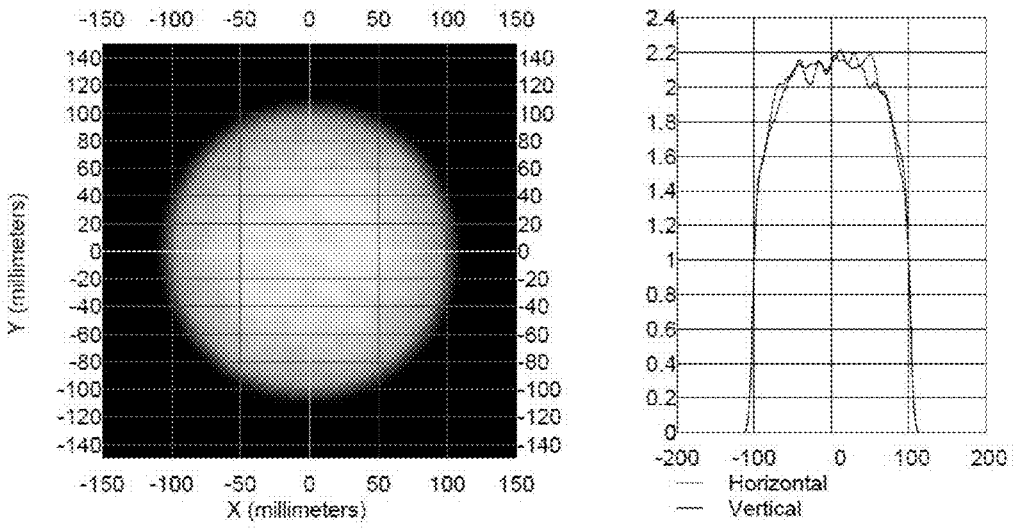
Figure 9C:
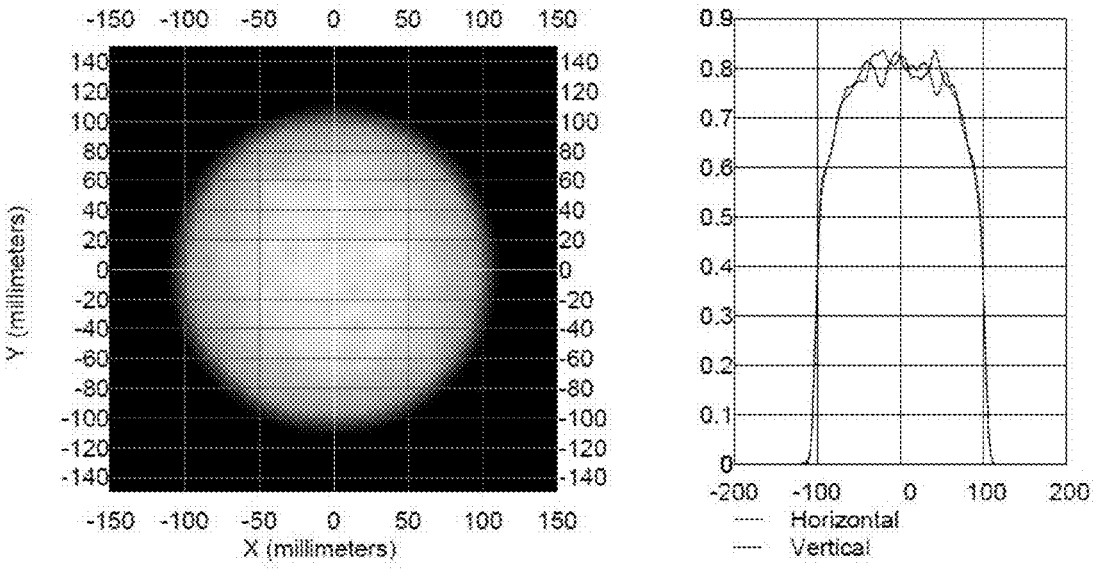

Preferably, the blue-green, yellow, and red LED light sources all have a Lambertian light distribution curve, and have a same half-intensity angle; then a radius of the circular array is $$r = \sqrt{\frac{2}{m+2}} \times z,$$

where m is a coefficient related to the half-intensity angle of the LED light sources, $$m = \frac{-\ln 2}{\ln(\cos\theta)},$$

θ is the half-intensity angle, and z is a distance between the LED light sources and the diffuser plate. Because the blue-green, yellow, and red LED light sources are all located on the same plane, i.e., the substrate, the LED light source is one of the blue-green, yellow, and red LED light sources. The most uniform illuminance of the light spot output by the LED lamp can be achieved by setting the radius of the circle according to the above method. Illustration is made by using the design of a down lamp having an output light spot of 8 inches (203 mm) as an example; then, LED light sources are arranged in a circular array, the numbers of blue-green, yellow, and red LEDs are separately 6, LEDs of different colors are arranged alternately, z is set to 80 mm, and when the half-intensity angle θ is 60°, the radius value r of the circular array through which the most uniform illuminance is achieved is calculated to be 65 mm At this time, when the blue-green light, yellow light, and red light are disposed in a circular array having a radius of 65 mm to form the LED lamp, obtained diagrams illustrating light spots in an illuminance simulation design of the array of the blue-green, yellow, and red LED light sources on the surface of the diffuser plate are shown in FIGS. 9*a,* 9*b* and 9*c* respectively. As shown in FIG. 9, the light spots of the array of blue-green light, yellow light, and red light irradiated on the surface of the diffuser plate all have a size of 203 mm and have uniform illuminance, so that the light spot formed by superposition also has uniform chrominance.

Further preferably, the reflector in the LED lamp is a frosted reflector. The frosted reflector mainly can collect edge rays and compress the light spots of the LED light source array output to the reflector to make the light spots have the same size as the light spots on the diffuser plate.

Still further preferably, the substrate in the LED lamp is plated with a reflective film. The substrate plated with the reflective film can collect rays reflected by the reflector and the diffuser plate to the bottom, thereby improving the light utilization rate of the system.

Still further preferably, the diffuser plate in the LED lamp is a PC diffuser plate (polycarbonate, PC for short in English), a PMMA diffuser plate (polymethylmethacrylate, PMMA for short in English) or frosted glass, so that the diffuser plate can perform secondary light and color uniformization so as to improve the uniformity of emergent light.

The above contents are further detailed descriptions of the present invention made through specific preferred embodiments, and it cannot be considered that specific implementations of the present invention are limited to the descriptions. Persons of ordinary skill in the art can make several replacements or obvious variations having the same performance or usage without departing from the idea of the present invention, and the replacements or variations should all be considered as falling within the protection scope of the present invention.

What is claimed is:

1. A light emitting diode (LED) lamp, comprising a heatsink, a reflector, a diffuser plate, and a substrate having an LED light source module disposed thereon, wherein the LED light source module comprises at least one group of LED light source components, and the LED lamp further comprises three drive circuits and a control circuit;

the LED light source components comprise a first LED light source providing blue-green light, a second LED light source providing yellow light, and a third LED light source providing red light; the first light source comprises a first blue LED chip having a peak wavelength of 445-455 nm, a green phosphor having a peak wavelength of 500-520 nm is coated on the first blue LED chip, and blue light accounts for a luminous power proportion of 0.43-0.57 in the provided blue-green light; the second light source comprises a second blue LED chip having a peak wavelength of 445-455 nm, a yellow phosphor having a peak wavelength of 557-570 nm is coated on the second blue LED chip, and blue light accounts for a luminous power proportion of 0-0.08 in the provided yellow light; the third light source comprises a third red LED chip having a peak wavelength of 624-630 nm;

the control circuit stores a correspondence table of a luminous flux ratio of each light source and chrominance parameters of a mixed light source; at the luminous flux ratio of each light source, the chrominance parameters satisfy the following conditions: a color temperature is adjustable within a range of 2700K-6500K, and at each color temperature, a general color rendering index Ra of the light source is greater than or equal to 90, a special color rendering index R9 is greater than or equal to 95, and a chromaticity difference ΔC is less than 0.0054; the control circuit selects, according to a mixed color temperature required by a user, a corresponding luminous flux ratio of each light source, determines a drive current of each light source according to the luminous flux ratio of each light source, and separately outputs the calculated drive current to a corresponding drive circuit; and the three drive circuits output the received drive currents to corresponding LED light sources and drive the corresponding LED light sources to emit light.

2. The LED lamp according to claim 1, wherein the three drive circuits adjust the drive currents by means of pulse width modulation (PWM).

3. The LED lamp according to claim 1, wherein multiple LED light sources in the LED light source module are arranged in a circular array, LED light sources providing light of different colors are disposed alternately, and all the LED light sources have a same light distribution curve.

4. The LED lamp according to claim 3, wherein the first LED light source, the second LED light source, and the third LED light source all have a Lambertian light distribution curve, and have a same half-intensity angle; a radius of the circular array is $$r = \sqrt{\frac{2}{m+2}} \times z,$$

where m is a coefficient related to the half-intensity angle of the LED light sources, $$m = \frac{-\ln 2}{\ln(\cos\theta)},$$

θ is the half-intensity angle, and z is a distance between the LED light sources and the diffuser plate.

5. The LED lamp according to claim 1, wherein the reflector is a frosted reflector.

6. The LED lamp according to claim 1, wherein the substrate is plated with a reflective film.

7. The LED lamp according to claim 1, wherein the diffuser plate is a polycarbonate (PC) diffuser plate, a polymethylmethacrylate (PMMA) diffuser plate, or frosted glass.

* * * * *